United States Patent [19]

Bünger et al.

[11] Patent Number: 4,579,266

[45] Date of Patent: Apr. 1, 1986

[54] PAPER DISPENSING DEVICE

[75] Inventors: Karl-Heinz Bünger, Porta Westfalica, Fed. Rep. of Germany; Willem J. Emmen, Hilvarenbeek, Netherlands

[73] Assignee: 501 Edet Nederland B.V. Tilburg, Netherlands

[21] Appl. No.: 576,198

[22] Filed: Feb. 2, 1984

[30] Foreign Application Priority Data

Feb. 26, 1983 [DE] Fed. Rep. of Germany ... 8305468[U]

[51] Int. Cl.[4] ..... A47K 10/38

[52] U.S. Cl. ..... 225/19; 225/42; 225/77; 225/91

[58] Field of Search ..... 225/42, 19, 77, 106, 225/91; 206/409, 406, 404; 221/282–286, 287

[56] References Cited

U.S. PATENT DOCUMENTS

| | | | |
|---|---|---|---|
| 1,699,476 | 1/1929 | Morin | 221/283 X |
| 3,211,329 | 10/1965 | Boyd | 221/283 X |
| 3,923,223 | 12/1975 | Larsson et al. | 225/46 |
| 4,426,029 | 1/1984 | Kamp | 221/91 X |

FOREIGN PATENT DOCUMENTS

| | | | |
|---|---|---|---|
| 0068722 | 1/1983 | European Pat. Off. . | |
| 0091411 | 10/1983 | European Pat. Off. . | |
| 2818757 | 11/1979 | Fed. Rep. of Germany . | |
| 2063213 | 6/1981 | United Kingdom | 225/42 |

*Primary Examiner*—Frank T. Yost

*Attorney, Agent, or Firm*—John P. Snyder

[57] ABSTRACT

A paper dispensing device comprising a holder containing a paper web reel and consisting of a support (4) to be fastened to a substrate (3) and a hood (5) to be releasably fixed to said support (4), said support (4) having a central opening (9) for passing the paper web and at the side of said opening at least one ripping edge (10), while in the operational state of the device the hood covers the reel on the support, wherein the support has a rim (8) protruding like a console and passing around the side intended for the substrate, at the lower end to be fastened to the support the hood (5) has a substantially U-shaped widening (13) for receiving the rim (8) of the support (4), in the mounted position the hood grips around the rim of the support by its widened part partly from above, laterally and from below, and the hood (5) can be slipped in a self-clamping manner onto the rim (8) of the support (4) and can be fastened thereto in its end position in a resilient manner, in order to simply close and open the dispenser for inserting said paper web reel.

12 Claims, 7 Drawing Figures

PAPER DISPENSING DEVICE

The invention relates to a paper dispensing device comprising a holder containing a paper web reel and consisting of a support to be fastened to a substrate and a hood to be releasably fixed to said support, said support having a central opening for passing the paper web and at the side of said opening at least one ripping edge, whilst in the operational state of the device the hood covers the reel on the support.

In sanitary systems and hospitals or—in general—at any place where moistures or dirt has to be swept away it is now preferred to use more or less absorptive paper. The paper may be available in specially folded single pieces or on a reel with a perforated paper web. It is, however, also possible to wind the paper without perforation to form a reel to be arranged in a holder, from which it can be picked up to any desired length.

Such a holder, which is preferably fastened to the wall, has an opening below through which the paper can be drawn out of the holder. At the side of the opening the holder has a ripping edge formed for example by sharp extensions by means of which the paper can be separated. This mode of stocking and dispensing paper is least expensive. Thereto, the holder should also be as simple and as cheap as possible.

The invention has for its object to provide a paper dispensing device of simple construction, which can be simply closed and opened and which ensures that the paper reel or the interior of the holder is protected from humidity.

According to the invention in a device of the kind set forth this problem is solved in that the support has a rim protruding like a console and passing around the side intended for the substrate, at the lower end to be fastened to the support the hood has a substantially U-shaped widening for receiving the rim of the support.

in the mounted position the hood grips around the rim of the support by its widened part partly from above, laterally and from below, and the hood can be slipped in a self-clamping manner onto the rim of the support and can be fastened thereto in its end position in a resilient manner.

Such a device comprises only the two parts: support and hood. The construction is, therefore, very simple. Since the hood can be slipped in a self-clamping member onto the support, no tools are required for assembling these two parts. Moreover, no additional manipulations are required, since the hood is slipped onto the support and locked in its end position by resiliently snapping elements. After mounting the hood grips around the rim of the support both on the side and from below. Since the integral hood itself is moisture-proof, the support and hence the paper reel below the hood are effectively protected against moisture.

An embodiment of the invention is shown in the drawings, in which.

Figure 1:
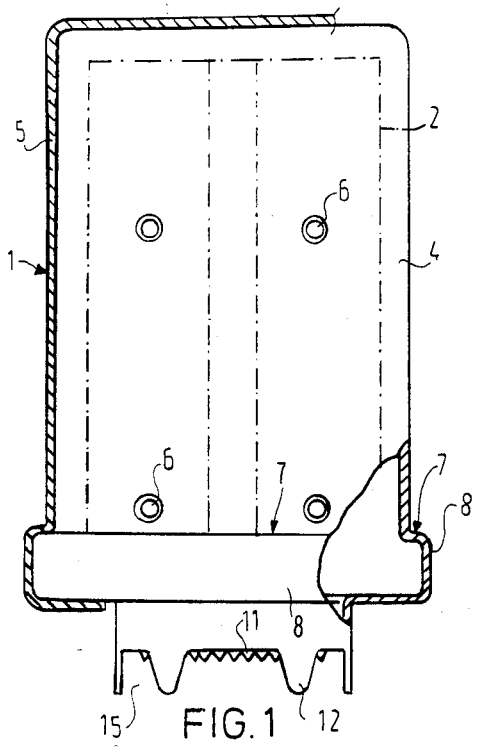
FIG. 1 is a front view of the support of a device embodying the invention.
Figure 2:
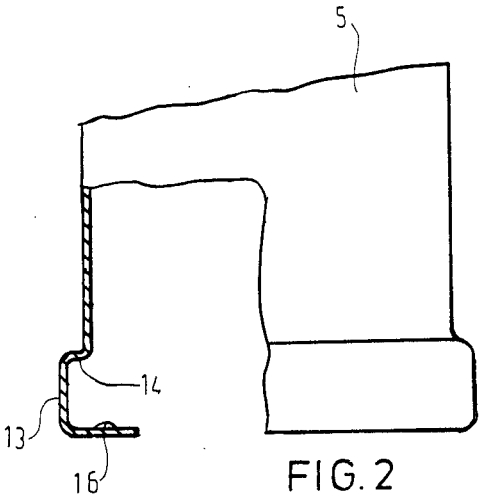
FIG. 2 is partly a sectional view of the hood.
Figure 3:
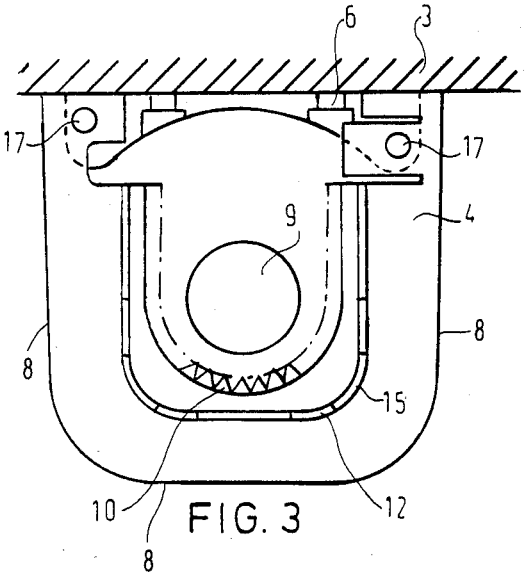
FIG. 3 is a bottom view of the support.

Reference numeral 1 designates a holder for a paper reel 2, a wound, non-perforated paper strip. The reel 2 is indicated in FIG. 1 by dot-and-dash lines. The holder 1 comprises a support 4 to be fastened to a substrate, preferably a wall 3, and a hood 5, which can be put on the support 4 to cover the reel 2. When the hood 5 is made from transparent material, for example, dark-shaded acryl glass, the reel 2 can be seen from the outside. It can be seen how much paper is present in the reel 2.

The support 4 may be secured by means of screws 6 to the wall 3. It has a supporting surface 7 on which the reel 2 can be arranged. The part having the supporting surface 7 and being topmost in the position of use of the support 4 is provided with a console-like protruding rim 8, which extends around the side intended to receive the device on the wall 3. The supporting surface 7 has furthermore a central opening 9, through which paper can be drawn from the reel 2 out of the holder 1. The paper is preferably drawn from the middle of the reel 2.

Figure 4:
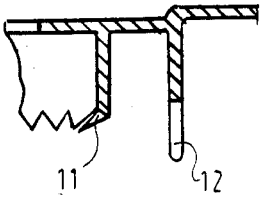
FIG. 4 shows a section of the support on an enlarged scale.

At the side of the opening 9 the support 4 is furthermore provided with a ripping edge 10, which is formed in the embodiment shown by sharp extensions 11 lying side by side and preferably being inclined towards the opening 9, as will be apparent from FIG. 4. At the ripping edge 10 the paper drawn out of the holder 1 can be severed from the endless strip to the desired length.

On the side of the ripping edge 10 remote from the opening 9 a protective strip 12 is protruding substantially at right angles to prevent injury of those who take paper from the holder 1 at the extensions 11 of the ripping edge 10. The strip 12 has discontinuities 15 through which the paper can be drawn out and cut at the ripping edge 10. The ripping edge 10 may, as an alternative, be divided in a plurality of sections; in principle, a section of the ripping edge 10 need then be provided only behind each discontinuity 15 of the strip 12.

The hood 5 is an integral unit and is open at the end to be fastened to the support 4 as well as on the side contacting the wall 3 in the mounted state. At its open end the hood has a substantially U-shaped widened part 13 by which it can be slipped from the front onto the rim 8 of the support. The widened part 13 and the rim 8 may, for example, have such a conical shape that the hood 5 can be slipped onto the rim in a self-clamping manner so that the rim is firmly enclosed. In the final position, in which the hood 5 is lying on the wall 3, the hood is fixed to the support 4 by resiliently snapping elements. The elements may be extensions 16 provided in the widened part 13 of the hood 5 and engaging depressions 17 of the support 4. It is advantageous to arrange them in covered position so that they can be unlocked by competent persons to charge the holder with a new paper reel 2.

By its U-shaped widened part 13 the hood 5 grips around the rim 8 of the support 4, partly from above by the side serving in addition as a support, completely at the side and, in addition, from below. Consequently, moisture, for example, water can no longer penetrate into the holder 1, provided the hood 5 is not damaged. A release of the hood 5 from the support 4 is prevented by the widened part 13.

Figure 5:
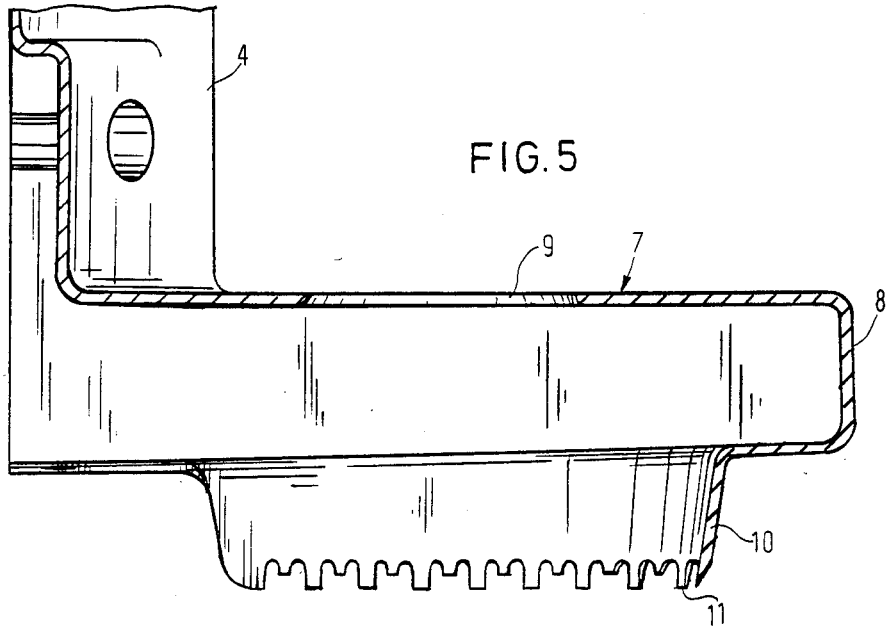
FIG. 5 shows the bottom part of an alternative support on an enlarged scale.
Figure 6:
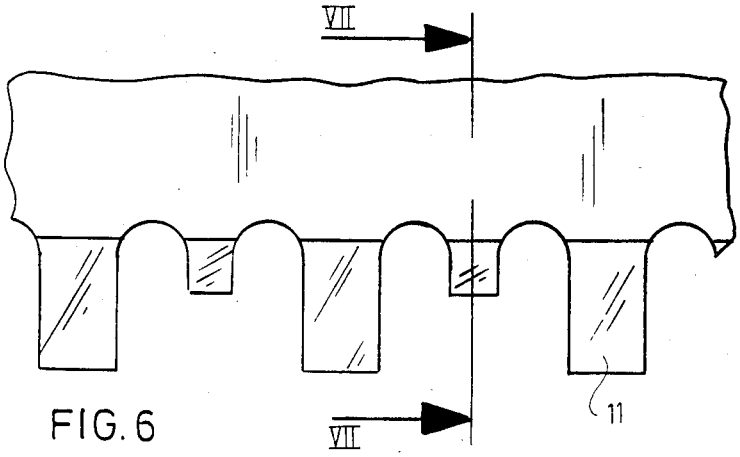
FIG. 6 shows a detail view of the ripping edge in FIG. 5.
Figure 7:
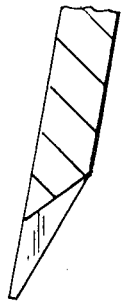
FIG. 7 is a sectional view along the line VII—VII in FIG. 6.

The FIGS. 5, 6 and 7 show an alternative embodiment of the support structure. In the figures the same reference numerals are used for similar parts. The ripping edge 10' is a bit inclined so minimizing the danger of injury for the user. In this embodiment the protecting strip 12 can be abandoned. The extensions 11 have here different dimensions, which will ameliorate the separation of a paperlength.

The invention is not restricted to the embodiments as described above.

What is claimed is:

1. A paper dispensing device comprising the combination of:

a supporting structure adapted to be attached to a support such as a wall, said supporting structure including a supporting surface for retaining a roll of paper while a length of paper is pulled from the roll, said supporting surface having an opening through which such length of paper may be pulled and having a peripheral portion of generally U-shaped plan view; and hood means for receiving said supporting structure in interfitted relation therewith defining an enclosure adapted to receive the roll of paper, said hood means having an open side and an open end and recess means at said open end receiving said peripheral portion of the supporting surface for simultaneously locating the hood means relative to said supporting structure and clamping said supporting surface to maintain said interfitted relation.

2. A device as defined in claim 1 including cutting edge means on said supporting surface below said opening for allowing a desired length of paper to be torn off by the user.

3. A device as defined in claim 2 including guard means on said supporting surface adjacent said cutting edge means for exposing only portions of said cutting edge means.

4. A device as defined in any one of claims 1–3 wherein said supporting surface is of U-shape in cross-section and said recess means is also of U-shape in cross-section, said recess means snugly receiving said peripheral portion of said shelf means throughout the lengths thereof.

5. A device as defined in claim 4 wherein said supporting structure includes an upstanding attaching portion and said supporting surface projects horizontally therefrom.

6. A device as defined in claim 5 wherein said open side of the hood means cooperates with the support to which the supporting structure is attached substantially to abut thereagainst.

7. A device as defined in any one of claims 1–3 including at least one tab on said hood means and a detent in said supporting surface for releasably locking said hood means and said supporting structure in said interfitted relation.

8. A device as defined in claim 7 wherein said supporting surface is of U-shape in cross-section and said recess means is also of U-shape in cross-section, said recess means snugly receiving said peripheral portion of said supporting surface throughout the lengths thereof.

9. A device as defined in claim 8 wherein said supporting structure includes an upstanding attaching portion and said supporting surface project horizontally therefrom.

10. A device as defined in claim 9 wherein said open side of the hood means cooperates with the support to which the supporting structure is attached substantially to abut thereagainst.

11. A paper dispensing device for retaining a roll of paper while successive lengths of paper are pulled from the roll and torn off at selected lengths thereof, comprising the combination of:

a supporting structure adapted to be mounted on a wall and surface means projecting from said supporting surface, said surface means presenting a protruding rim having a generally U-shaped periphery;

hood means for slidable engagement with said protruding rim in the direction parallel to said surface means so that the hood means and the supporting structure may be interfitted to a final relative position which defines a space, bounded at one end of said hood means by said surface means, within which the roll of paper is captured and held, said hood means being open at said one end thereof and being provided thereat with means for clamping said rim in orthogonal directions;

detent means for latching said hood means and said supporting structure in said final relative position;

said surface means being provided with an opening through which a length of paper may be pulled while the roll of paper is held in captured relation within said space; and cutting means adjacent said opening exteriorally of said space for cutting through the paper as it is pulled thereagainst.

12. A device as defined in claim 11 wherein said means for clamping is defined by wall portions of said hood means disposed in generally U-shaped configuration in cross-section and in plan view.

* * * * *